US008712278B2

(12) United States Patent
Yamaguchi et al.

(10) Patent No.: US 8,712,278 B2
(45) Date of Patent: Apr. 29, 2014

(54) IMAGE FORMING APPARATUS HAVING EXHAUST FAN

(75) Inventors: Takuya Yamaguchi, Toyokawa (JP); Norio Uchida, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 271 days.

(21) Appl. No.: 13/249,859

(22) Filed: Sep. 30, 2011

(65) Prior Publication Data

US 2012/0087693 A1 Apr. 12, 2012

(30) Foreign Application Priority Data

Sep. 30, 2010 (JP) ..... 2010-221291

(51) Int. Cl.
*G03G 21/20* (2006.01)

(52) U.S. Cl.
USPC ..... 399/92

(58) Field of Classification Search
USPC ..... 399/92, 93, 112; 355/30; 347/18
See application file for complete search history.

(56) References Cited

U.S. PATENT DOCUMENTS

| | | | | |
|---|---|---|---|---|
| 5,390,006 | A * | 2/1995 | Wakabayashi et al. | 399/92 |
| 5,479,242 | A * | 12/1995 | Sato et al. | 399/92 |
| 6,415,118 | B1 * | 7/2002 | Setoriyama et al. | 399/92 |
| 6,473,152 | B1 * | 10/2002 | Yokota | 355/30 |
| 6,628,906 | B2 * | 9/2003 | Kimizuka | 399/44 |
| 7,403,731 | B2 * | 7/2008 | Mori | 399/92 |
| 7,512,355 | B2 * | 3/2009 | Fujii et al. | 399/92 |
| 7,599,641 | B2 * | 10/2009 | Yoshihara et al. | 399/94 |
| 7,826,763 | B2 * | 11/2010 | Doshohda et al. | 399/93 |
| 8,170,432 | B2 * | 5/2012 | Takeuchi | 399/49 |
| 2006/0169436 | A1 | 8/2006 | Ohkura | |

FOREIGN PATENT DOCUMENTS

| | | | |
|---|---|---|---|
| JP | HEI02-109359 | | 8/1990 |
| JP | 08-044274 | A | 2/1996 |
| JP | 08-137371 | A | 5/1996 |
| JP | H09-305073 | A | 11/1997 |
| JP | HEI10-228226 | | 8/1998 |
| JP | 2006-58528 | | 3/2006 |
| JP | 2006-209025 | A | 8/2006 |
| JP | 2008-170695 | | 7/2008 |
| JP | 2010-079047 | A | 4/2010 |

OTHER PUBLICATIONS

Japanese Office Action dated Oct. 2, 2012 received from the Japanese Patent Office in related case JP2010-221291.

(Continued)

*Primary Examiner* — Robert Beatty
(74) *Attorney, Agent, or Firm* — Scully, Scott, Murphy & Presser PC

(57) ABSTRACT

An image forming apparatus comprising a process unit having a charger that charges a photosensitive member, a fixing unit having a heat source for thermally fixing a developer image formed on a recording sheet by the process unit, an apparatus body configured to accommodate the process unit and the fixing unit and having an ejection port above the fixing unit, the ejection port being used for ejecting the recording sheet ejected from the fixing unit to the outside of the image forming apparatus and an exhaust fan configured to discharge air inside the apparatus body to the outside of the image forming apparatus. The exhaust fan is disposed at a fixing-unit side of the process unit and is disposed lower than both the charger and the heat source such that air entering through the ejection port from outside the image forming apparatus flows through the fixing unit and is discharged by the exhaust fan.

14 Claims, 7 Drawing Sheets

(56) References Cited

OTHER PUBLICATIONS

Chinese Notification of First Office Action dated Feb. 5, 2013 received in related Japanese Application No. 2011-10297728.1.

Notice of Reasons for Rejection dated Apr. 16, 2013 received in corresponding JP 2010-221291, together with partial English translation.

Notification of the Second Office Action against Chinese patent application No. 201110297728.1 dated Nov. 4, 2013.

* cited by examiner

IMAGE FORMING APPARATUS HAVING EXHAUST FAN

CROSS REFERENCE TO RELATED APPLICATION

The present application claims priority from Japanese Patent Application No. 2010-221291, which was filed on Sep. 30, 2010, the disclosure of which is incorporated herein by reference in its entirety.

BACKGROUND

1. Field of the Invention

The present invention relates to an image forming apparatus including an exhaust fan that discharges air inside the apparatus body to the outside of the apparatus.

2. Description of the Related Art

An image forming apparatus having an exhaust fan for discharging air inside the apparatus body to the outside of the apparatus. The exhaust fan is disposed above a charger and a fixing unit and is used for discharging ozone generated from the charger and heat from the fixing unit to the outside of the apparatus via a filter.

In the image forming apparatus, because the ozone is heavier than air, the ozone cannot be efficiently discharged. Furthermore, because air taken through the ejection port is discharged by the exhaust fan before the air reaches the fixing unit, peripheral components overheated by the fixing unit cannot be efficiently cooled.

SUMMARY

A need has arisen to provide an image forming apparatus that can efficiently discharge ozone and that can efficiently cool peripheral components.

According to an embodiment of the present invention, the image forming apparatus comprises a process unit having a charger that charges a photosensitive member, a fixing unit having a heat source for thermally fixing a developer image formed on a recording sheet by the process unit, an apparatus body configured to accommodate the process unit and the fixing unit and having an ejection port above the fixing unit, the ejection port being used for ejecting the recording sheet ejected from the fixing unit to the outside of the image forming apparatus and an exhaust fan configured to discharge air inside the apparatus body to the outside of the image forming apparatus. The exhaust fan is disposed at a fixing-unit side of the process unit and is disposed lower than both the charger and the heat source such that air entering through the ejection port from outside the image forming apparatus flows through the fixing unit and is discharged by the exhaust fan.

According to another embodiment of the present invention, the image forming apparatus includes a process unit having a charger that charges a photosensitive member, a fixing unit having a heat source for thermally fixing a developer image formed on a recording sheet by the process unit, an apparatus body configured to accommodate the process unit and the fixing unit and having an ejection port above the fixing unit, the ejection port being used for ejecting the recording sheet ejected from the fixing unit to the outside of the image forming apparatus and an exhaust fan configured to discharge air inside the apparatus body to the outside of the image forming apparatus. The exhaust fan is disposed at a fixing-unit side of the process unit and is disposed lower than both the charger and the heat source. An additional exhaust fan is not disposed at the fixing-unit side of the process unit and between the exhaust fan and the ejection port.

DESCRIPTION OF THE PREFERRED EMBODIMENTS

Figure 1:
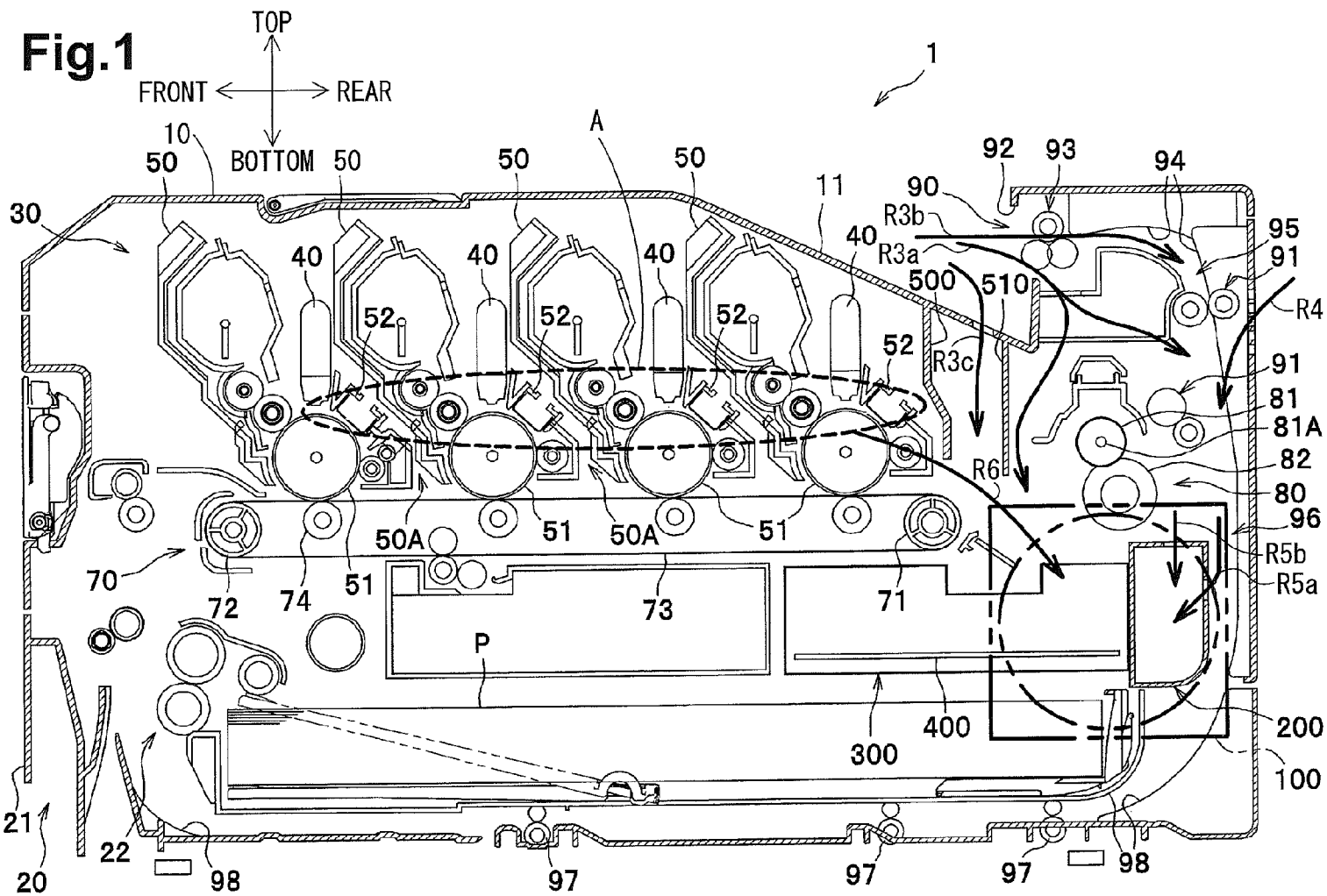
FIG. 1 is a cross-sectional view illustrating the overall configuration of a color printer according to an embodiment of the present invention.

An embodiment of the present invention will be described in detail below with reference to the drawings. In the description below, the overall configuration of a color printer serving as an example of an image forming apparatus will be briefly described first, and then the characteristic features of the present invention will be described in detail.

The directions in the following description are based on those viewed by the user when the color printer is used. Specifically, in FIG. 1, when viewed toward the drawing, the left side will be referred to as "front side", the right side will be referred to as "rear side", the far side will be referred to as "left side", and the near side will be referred to as "right side". Moreover, when viewed toward the drawing, the up-down direction will be referred to as "vertical direction".

As shown in FIG. 1, a color printer 1 has an apparatus body 10 that contains therein a feed unit 20 that feeds sheets P as an example of recording sheets, an image forming unit 30 that forms an image on each fed sheet P, and an ejecting unit 90 that ejects the sheet P having the image formed thereon.

The feed unit 20 is disposed below the image forming unit 30, and includes a feed tray 21 as an example of a recording-sheet accommodating section that accommodates the sheets P and a sheet feeder 22 that conveys each sheet P from the feed tray 21 to the image forming unit 30. In the feed unit 20, the sheet feeder 22 conveys the sheet P from the feed tray 21 toward the image forming unit 30 such that the sheet P makes a U-turn from the front toward the rear.

The image forming unit 30 includes four LED units 40, four process cartridges 50 as an example of a process unit, a transfer unit 70, and a fixing unit 80.

Each of the LED units 40 has multiple LEDs and projects light onto a corresponding photosensitive drum 51 serving as an example of a photosensitive member, to be described later.

The process cartridges 50 are arranged in the front-rear direction (so that chargers 52 are arranged horizontally), and each include a photosensitive drum 51, a charger 52, a known developing roller (shown without a reference numeral), and a known toner chamber (shown without a reference numeral).

The transfer unit 70 is provided between the feed unit 20 and the process cartridges 50, and includes a driving roller 71, a driven roller 72, a conveying belt 73, and transfer rollers 74.

The driving roller 71 and the driven roller 72 are spaced apart from and disposed parallel to each other in the front-rear direction, and the conveying belt 73 formed of an endless belt is stretched therebetween. The outer surface of the conveying belt 73 is in contact with the photosensitive drums 51. The conveying belt 73 is nipped between the photosensitive drums 51 and four transfer rollers 74, which are disposed at the inner side of the conveying belt 73 so as to face the respective photosensitive drums 51. Transfer bias is applied to the transfer rollers 74 during a transfer process.

The fixing unit 80 is disposed to the rear of the process cartridges 50 and the transfer unit 70, and includes a heating roller 81 internally equipped with a halogen heater 81A as an example of a heat source, and a pressing roller 82 disposed facing the heating roller 81 so as to press the heating roller 81. An exhaust fan 100 that discharges air inside the apparatus body 10 outward of the apparatus is provided below the halogen heater 81A of the fixing unit 80. The exhaust fan 100 and the surrounding structure thereof will be described later in detail.

In the image forming unit 30 having the above-described configuration, the surface of each photosensitive drum 51 is uniformly charged by the corresponding charger 52 before being exposed to light by the corresponding LED unit 40. Thus, the electric potential of the exposed section is lowered, thereby forming an electrostatic latent image based on image data on the photosensitive drum 51. Then, toner is supplied to the electrostatic latent image from the corresponding developing roller, whereby the photosensitive drum 51 bears a toner image thereon.

Subsequently, a sheet P fed onto the conveying belt 73 passes between the photosensitive drums 51 and the transfer rollers 74 so that the toner image formed on each photosensitive drum 51 is transferred onto the sheet P. Then, the sheet P passes between the heating roller 81 and the pressing roller 82, whereby the toner image transferred onto the sheet P is thermally fixed thereon.

The ejecting unit 90 includes a conveying roller 91 that conveys the sheet P, an ejecting roller 93 that ejects the sheet P outward (to an output tray 11) via an ejection port 92 formed so as to open frontward at a position above the fixing unit 80 in the apparatus body 10, and a guide 94 that guides the sheet P so that the sheet P makes a U-turn from the fixing unit 80 toward the ejection port 92. The rollers 91 and 93 and the guide 94 form a U-shaped ejection path 95 that guides the sheet P, having an image printed thereon by the image forming unit 30 and fixed thereon, outward from the apparatus body 10.

The ejection path 95 is continuously connected to a re-conveying path 96 for returning the sheet P from the ejection path 95 to the upstream side of the image forming unit 30 in the sheet conveying direction. The re-conveying path 96 is constituted of, for example, multiple reversing-conveying rollers 97 and guides 94 and 98.

In the ejecting unit 90, when performing simplex printing, the sheet P exiting the fixing unit 80 is conveyed by the ejection path 95 so as to make a U-turn from the rear toward the front, and is ejected outward to the output tray 11 via the ejection port 92. On the other hand, when performing duplex printing, the sheet P having an image printed on one face thereof is ejected halfway outward by the ejecting roller 93 and is subsequently sent (switched back) to the re-conveying path 96 by reverse rotation of the ejecting roller 93, so as to be re-fed in a reversed state to the upstream side of the image forming unit 30.

[Structure of Exhaust Fan and Surrounding Area Thereof]

Figure 2:
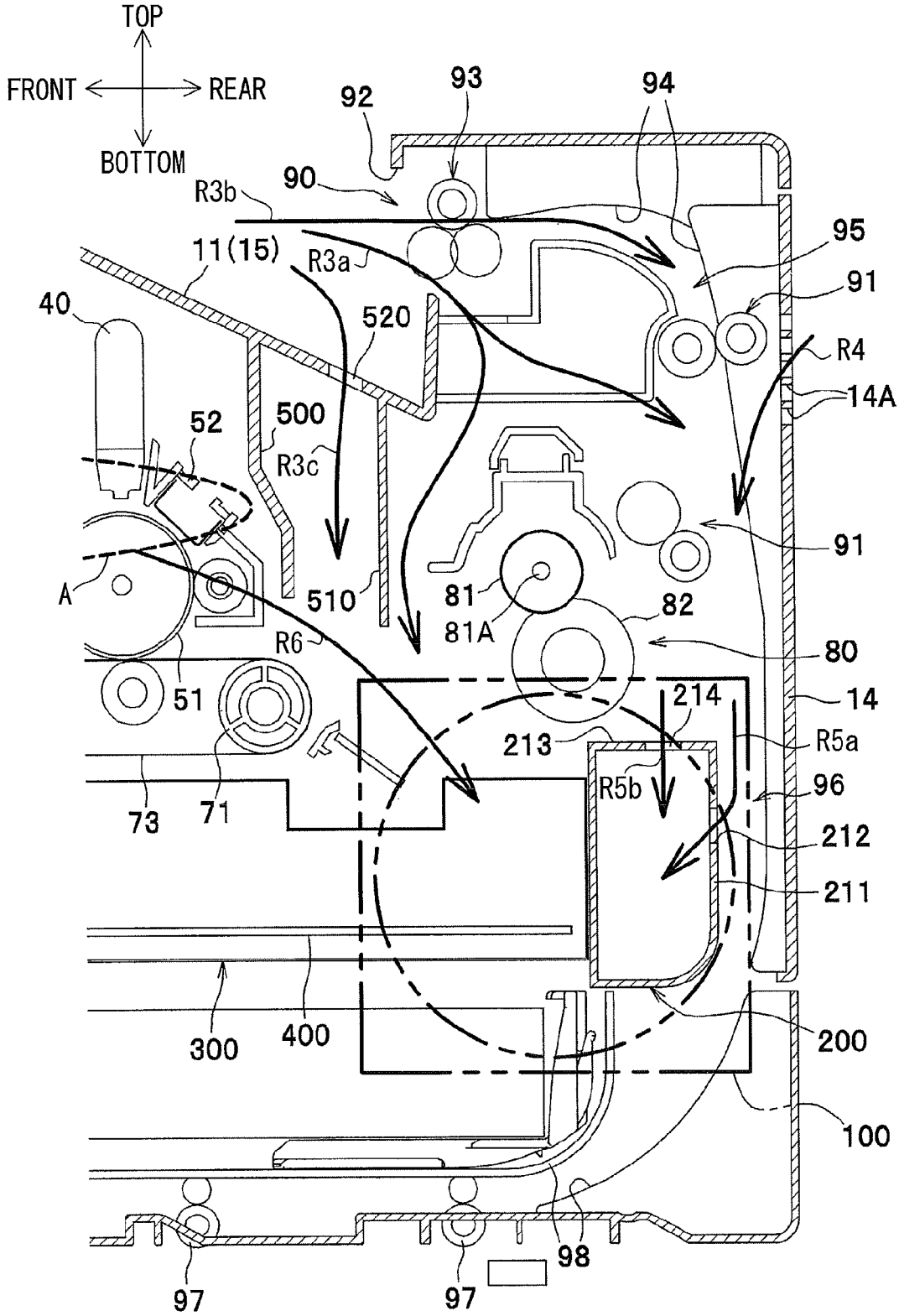
FIG. 2 is an enlarged cross-sectional view illustrating the structure of an exhaust fan and a surrounding area thereof.

As shown in FIG. 2, on a right side panel 12 (see FIG. 4) of the apparatus body 10, the exhaust fan 100 is provided to the rear (i.e., the fixing unit 80 side) of the rearmost process cartridge 50 (i.e., the downstream-most process cartridge 50 in the sheet conveying direction) and is positioned lower than the halogen heater 81A and the chargers 52. Thus, air taken into the apparatus through the ejection port 92 located above the fixing unit 80 travels through the fixing unit 80 via a route R3*a* and is subsequently discharged outward by the exhaust fan 100 located therebelow, thereby efficiently cooling peripheral components overheated by the fixing unit 80. Furthermore, even when ozone, which is heavier than air, is generated by the chargers 52, the ozone descending gravitationally from the chargers 52 is efficiently sucked in by the exhaust fan 100 disposed lower than the chargers 52 so as to be discharged outward from the apparatus.

Furthermore, as viewed in the left-right direction (i.e., width direction of recording sheet), the exhaust fan 100 is provided so as to overlap a section lower than the halogen heater 81A of the fixing unit 80 (e.g., a lower portion of the pressing roller 82). Thus, the apparatus body 10 can be reduced in size in the vertical direction.

Furthermore, only a single exhaust fan 100 is provided within the apparatus body 10. Therefore, since the air taken into the apparatus through the ejection port 92 is not discharged outward by another exhaust fan before the air reaches the exhaust fan 100 via the fixing unit 80, the peripheral components overheated by the fixing unit 80 can be efficiently cooled.

This advantage can be achieved so long as an additional exhaust fan is not provided at the fixing unit 80 side of the process cartridges 50 and between the exhaust fan 100 and the ejection port 92. Specifically, the aforementioned advantage can be achieved even if an additional exhaust fan is provided at a location (such as the front side of the apparatus body 10) other than this section.

A duct 200, a substrate container 300, and a power-supply substrate 400 are provided at positions facing the exhaust fan 100 in the left-right direction (i.e., positions overlapping each other in the rotation-axis direction of the exhaust fan 100).

Figure 3:
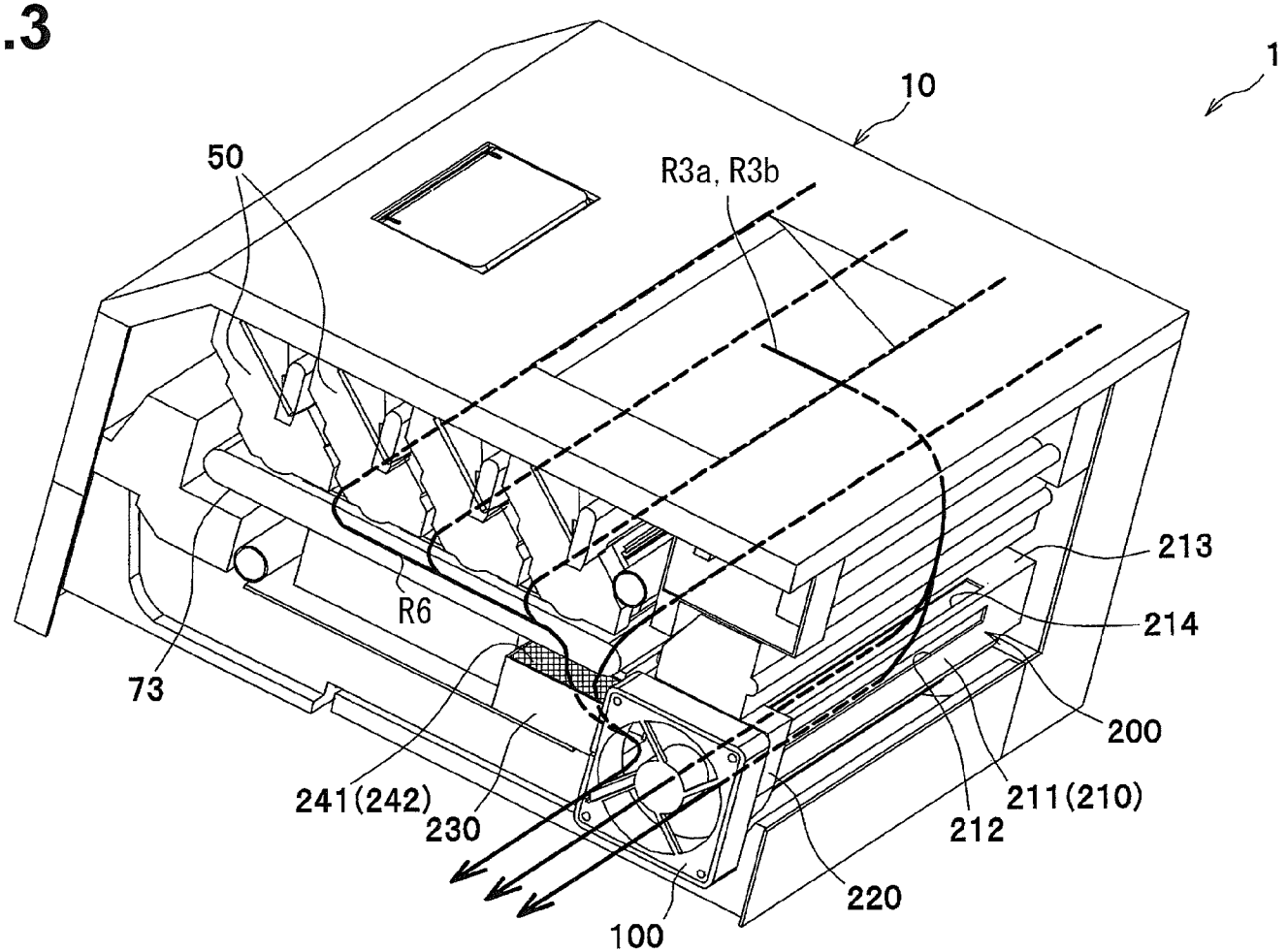
FIG. 3 is a perspective view illustrating the airflow inside an apparatus body.
Figure 4:
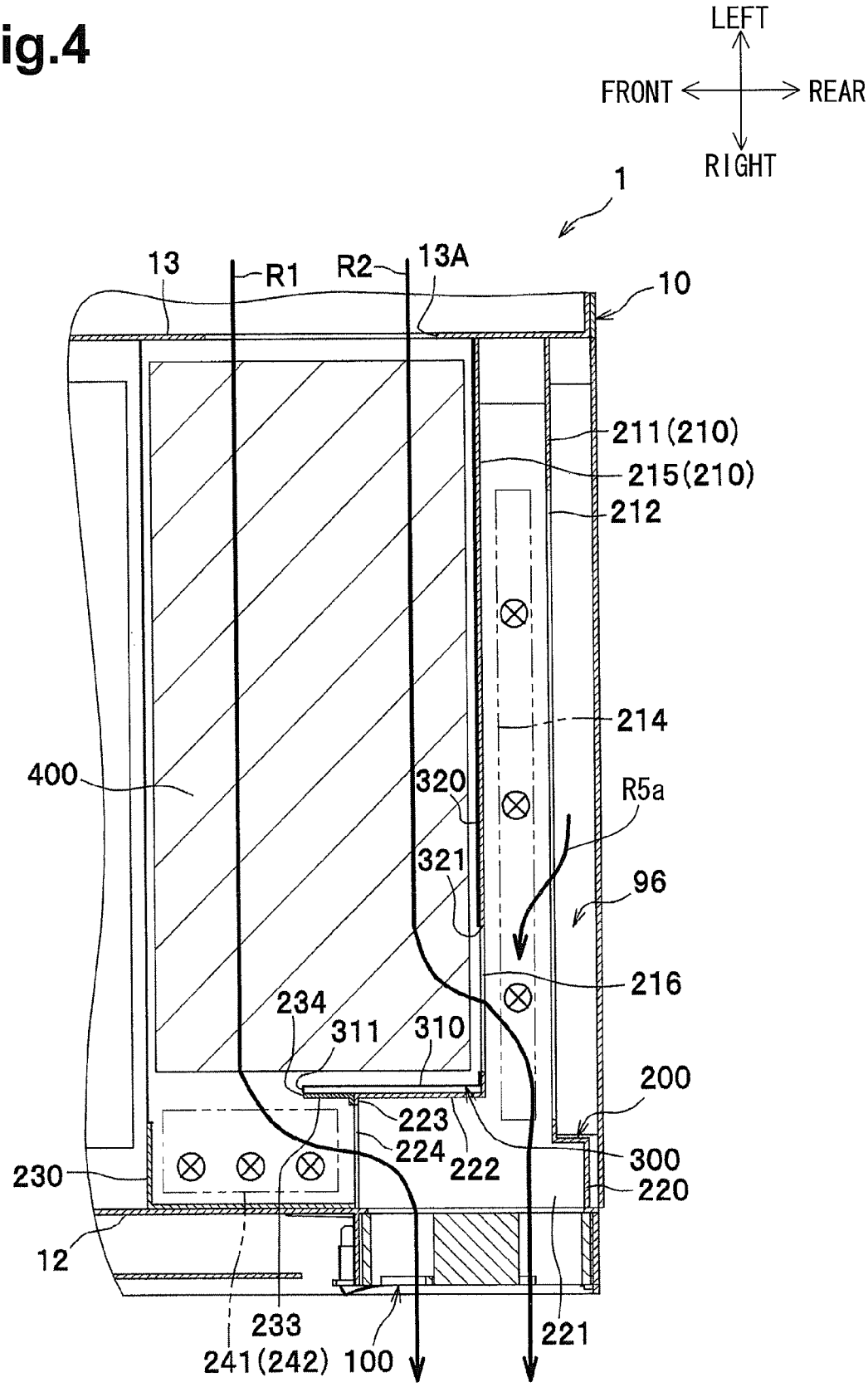
FIG. 4 is a cross-sectional view illustrating a substrate container and a duct.

As shown in FIGS. 3 and 4, the duct 200 is substantially L-shaped in plan view, and mainly includes a left-right extending portion 210 extending in the left-right direction, a connection portion 220 connected to the exhaust fan 100, and a merging portion 230 provided in front of and adjacent to the connection portion 220. The left-right extending portion 210 has a shape of a substantially rectangular tube extending in the left-right direction, and has a left end joined to a left side panel 13 of the apparatus body 10 and a right end integrally connected to the connection portion 220.

The left-right extending portion 210 has a rear wall 211 that serves as a part of the re-conveying path 96. The rear wall 211 has a rear intake port 212 that faces the re-conveying path 96 and that extends in the left-right direction. Consequently, since air within the re-conveying path 96 can be taken into the duct 200 via a route R5*a*, air outside the apparatus can be taken into the re-conveying path 96 through the ejection port 92 and multiple slit-like vent holes 14A formed in a rear cover 14, via a route R3*b*, shown in FIG. 2.

An upper wall 213 of the left-right extending portion 210 is provided with an upper intake port 214 that opens toward the fixing unit 80. Thus, air around the fixing unit 80 can be taken into the duct 200 via a route R5*b*, whereby air outside the apparatus can be supplied around the fixing unit 80 via the ejection port 92 and the vent holes 14A via a route R4.

Furthermore, as shown in FIG. 4, a communication hole 216 that allows the inside of the duct 200 and the inside of the substrate container 300 to communicate with each other is provided at the right side of a front wall 215 of the left-right extending portion 210. Thus, air within the substrate container 300 can be taken into the duct 200.

The connection portion 220 has a shape of a bottomed tube that opens rightward, and the opening thereof serves as a connection port 221 that is connected to the exhaust fan 100. A left wall 222 serving as a bottom wall of the connection portion 220 is integrally connected to the left-right extending portion 210 so that the left-right extending portion 210 communicates with the inside of the connection portion 220. A front wall 223 of the connection portion 220 is provided with a communication hole 224 that allows the inside of the connection portion 220 and the inside of the merging portion 230 to communicate with each other.

Figure 5:
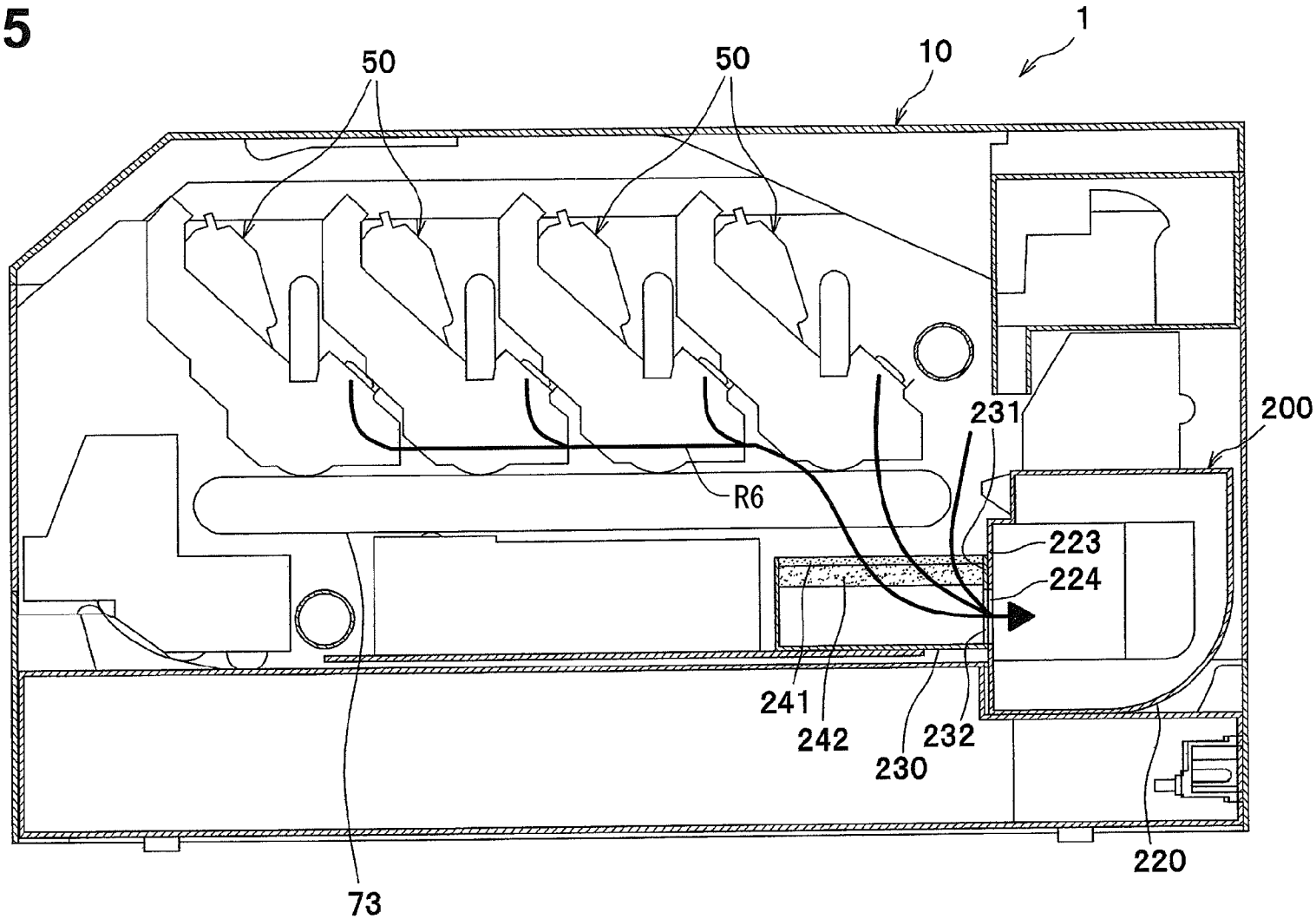
FIG. 5 is a cross-sectional view illustrating the structure of filters of the duct and a surrounding area thereof.

The merging portion 230 has a shape of a bottomed tube that opens upward, and the opening thereof is provided with a first filter 241 and a second filter 242 that are arranged in the vertical direction, as shown in FIG. 5, so as to block the opening. The first filter 241 is configured to capture waste, such as toner. The second filter 242 is configured to capture ozone and volatile organic compounds.

Consequently, ozone generated from the process cartridges 50 and waste, such as toner, can be appropriately removed (diluted) by the filters 241 and 242.

A rear wall 231 of the merging portion 230 is provided with a communication hole 232 that corresponds to the communication hole 224 in the connection portion 220. Furthermore, as shown in FIG. 4, a left wall 233 of the merging portion 230 is provided with a communication hole 234 that allows the inside of the merging portion 230 and the inside of the substrate container 300 to communicate with each other.

Consequently, air around the process cartridges 50 (chargers 52) taken in from above the merging portion 230 and air inside the substrate container 300 taken in from the left communication hole 234 are made to merge in a space (merging space) within the merging portion 230. In an air channel that connects the substrate container 300 to the exhaust fan 100, this merging space may be provided anywhere between the substrate container 300 and the exhaust fan 100.

As shown in FIG. 2, the substrate container 300 is provided below the fixing unit 80 and the conveying belt 73 and accommodates the power-supply substrate 400 that has a plate-like shape and that receives electricity from an external power source. As shown in FIG. 4, the substrate container 300 is formed in a shape of a bottomed tube that extends in the left-right direction and that opens leftward. The left end of the substrate container 300 is joined to the side panel 13.

In detail, the substrate container 300 is joined to the side panel 13 so as to surround, in the vertical and front-rear directions, multiple slit-like vent holes 13A formed in the side panel 13. Thus, air outside the apparatus can be taken into the substrate container 300 via the vent holes 13A.

The front side of a right wall 310 of the substrate container 300 is provided with a communication hole 311 that corresponds to the communication hole 234 in the merging portion 230, and the right side of a rear wall 320 is provided with a communication hole 321 that corresponds to the communication hole 216 in the left-right extending portion 210. A rear segment of the right wall 310 of the substrate container 300 and a front segment of the left wall 222 of the connection portion 220 are provided so as to face the exhaust fan 100.

Specifically, the rear segment of the right wall 310 of the substrate container 300 and the front segment of the left wall 222 of the connection portion 220 function as a shield wall for restricting air inside the substrate container 300 from being directly (linearly) sucked into the exhaust fan 100. With this shield wall, the air inside the substrate container 300 is forced to make a detour before being sucked into the exhaust fan 100. Thus, the amount of air sucked into the exhaust fan 100 from the substrate container 300 can be reduced by the shield wall (i.e., the right wall 310 and the left wall 222) so as to allow for an increased amount of air sucked in from around the fixing unit 80 by that reduced amount, thereby efficiently cooling the peripheral components overheated by the fixing unit 80.

As shown in FIG. 1, gaps 50A between the process cartridges 50 are each formed slantwise relative to the vertical direction so as to decrease in distance to the exhaust fan 100 with decreasing height. Thus, air in the gaps 50A between the process cartridges 50 (shown as a dashed demarcation A in FIGS. 1 and 2) is made to flow toward the exhaust fan 100 in a substantially linear flow in side view (i.e., a flow with a relatively large radius of curvature even when curved), whereby the ozone generated in the chargers 52 can be efficiently captured by a single exhaust fan 100 via a route R6.

Furthermore, as shown in FIG. 2, a pair of partition walls 500 and 510 that separate the rearmost process cartridge 50 and the fixing unit 80 from each other are spaced apart and provided between the aforementioned process cartridge 50 and the fixing unit 80. In detail, the partition wall 500 at the process cartridge 50 side extends downward from an upper wall 15 of the apparatus body 10. A lower end of the partition wall 500 is located at a position lower than the chargers 52 but higher than the sheet P conveyed from the process cartridges 50 toward the fixing unit 80.

The partition wall 510 at the fixing unit 80 side extends downward from the upper wall 15 of the apparatus body 10. A lower end of the partition wall 510 is located at a position lower than the halogen heater 81A but higher than the sheet P conveyed from the process cartridges 50 toward the fixing unit 80. With the pair of partition walls 500 and 510, an air layer is formed between the partition walls 500 and 510, thereby reducing an effect the temperature of the fixing unit 80 may have on the process cartridges 50.

Furthermore, an intake port 520 for taking in air from outside the apparatus is formed in the upper wall 15 of the apparatus body 10 between the partition walls 500 and 510. Thus, cool air from the outside can be taken into between the partition walls 500 and 510 via a route R3*c*, thereby further reducing an effect the temperature of the fixing unit 80 may have on the process cartridges 50.

The air between the partition walls 500 and 510 is sucked into the exhaust fan 100 via the duct 200 located lower than the partition walls 500 and 510. Thus, the air flowing downward from the partition walls 500 and 510 forms an air curtain, thereby reducing the amount of heated air at the fixing unit 80 side flowing toward the process cartridges 50.

Next, the airflow will be described.

As shown in FIGS. 2 and 3, when the exhaust fan 100 is driven, the air outside the apparatus is taken into the apparatus through the ejection port 92 and the vent holes 14A. This air travels around the fixing unit 80 and through the re-conveying path 96 before being taken into the duct 200 (left-right extending portion 210) via the intake ports 214 and 212 of the duct 200.

On the other hand, air around the process cartridges 50 flows obliquely downward and rearward as well as from left to right along the outer surfaces of the process cartridges 50 and subsequently passes by the conveying belt 73 (i.e., between the conveying belt 73 and the right side panel 12) so as to flow rearward. Furthermore, air taken into the apparatus via the intake port 520 flows downward along the pair of partition walls 500 and 510 as well as from left to right, and then passes by the conveying belt 73 so as to flow rearward. Subsequently, the two flows of air are taken into the duct 200 (merging portion 230) via the filters 241 and 242.

Furthermore, as shown in FIG. 4, air at the left side (outside the apparatus) of the apparatus body 10 is taken into the substrate container 300 via the vent holes 13A, and is subsequently discharged outward from the apparatus via two routes, that is, a first route R1 defined by the front-side communication holes 311 and 234, the merging portion 230, and the connection portion 220 and a second route R2 defined by the rear-side communication holes 321 and 216, the left-right extending portion 210, and the connection portion 220.

In this case, the air traveling along the first route R1 and the air from the process cartridges 50 merge in the merging portion 230, whereas the air traveling along the second route R2 and the air from around the fixing unit 80 and the re-conveying path 96 merge in the left-right extending portion 210. Then, the merged air is discharged outward from the apparatus by the exhaust fan 100.

Accordingly, the following advantages can be achieved in this embodiment.

Since the exhaust fan 100 is disposed lower than the chargers 52, ozone generated from the chargers 52 can be efficiently discharged outward from the apparatus. Furthermore, since the air entering the apparatus via the ejection port 92 is discharged by the exhaust fan 100 provided lower than the halogen heater 81A, the air entering the apparatus via the ejection port 92 can be discharged outward from the apparatus via near the fixing unit 80, whereby the peripheral components overheated by the fixing unit 80 can be efficiently cooled by the air outside the apparatus.

As viewed in the left-right direction, the exhaust fan 100 is provided so as to overlap a section lower than the halogen heater 81A of the fixing unit 80, whereby the apparatus body 10 can be reduced in size in the vertical direction, as compared with a structure in which an exhaust fan is disposed higher than a fixing unit so as not to overlap the fixing unit in the left-right direction.

Because the gaps 50A between the process cartridges 50 are each formed slantwise relative to the vertical direction so as to decrease in distance to the exhaust fan 100 with decreasing height, air in the gaps 50A is made to flow toward the exhaust fan 100 in a substantially linear flow in side view, whereby the ozone generated in the chargers 52 can be efficiently captured by a single exhaust fan 100.

Because the rear wall 211 of the duct 200 serves as a part of the re-conveying path 96, and this rear wall 211 is provided with the rear intake port 212 facing the re-conveying path 96, the air outside the apparatus can be taken into the re-conveying path 96 so as to cool inside the re-conveying path 96, thereby cooling the re-conveyed sheet P. In particular, since the exhaust fan 100 is disposed lower than the halogen heater 81A, air can be made to flow over a long distance from the ejection port 92 to the rear intake port 212, thereby efficiently cooling the sheet P. Furthermore, since the duct 200 taking in air is cooled by that air, the inside of the re-conveying path 96 disposed downstream of the rear intake port 212 is cooled by the cooled duct 200, whereby the sheet P conveyed downstream of the rear intake port 212 can also be cooled.

By providing the pair of partition walls 500 and 510 spaced apart from each other between the rearmost process cartridge 50 and the fixing unit 80, an air layer can be formed between the partition walls 500 and 510, thereby reducing an effect the temperature of the fixing unit 80 may have on the process cartridges 50.

By forming the intake port 520 for taking in air into between the partition walls 500 and 510 from outside the apparatus, cool air from the outside can be taken into between the partition walls 500 and 510, thereby further reducing an effect the temperature of the fixing unit 80 may have on the process cartridges 50.

Since only a single exhaust fan 100 is provided within the apparatus body 10, cost reduction can be achieved, as compared with a structure provided with two or more exhaust fans.

Since an additional exhaust fan is not provided between the exhaust fan 100 and the ejection port 92, air taken into the apparatus through the ejection port 92 can be prevented from being discharged outward by that exhaust fan before the air reaches the fixing unit 80, whereby the peripheral components overheated by the fixing unit 80 can be efficiently cooled.

Since the power-supply substrate 400 is provided so as to overlap the exhaust fan 100 in the rotation-axis direction of the exhaust fan 100, the exhaust fan 100 for cooling the peripheral components overheated by the fixing unit 80 can also be used for cooling the power-supply substrate 400.

The amount of air sucked into the exhaust fan 100 from the substrate container 300 can be reduced by the shield wall (i.e., the right wall 310 and the left wall 222) so as to allow for an increased amount of air sucked in through the ejection port 92 by that reduced amount, thereby efficiently cooling the peripheral components overheated by the fixing unit 80.

The present invention is not limited to the above-described embodiment, and can be used in various alternative embodiments described below as examples.

Figure 6:
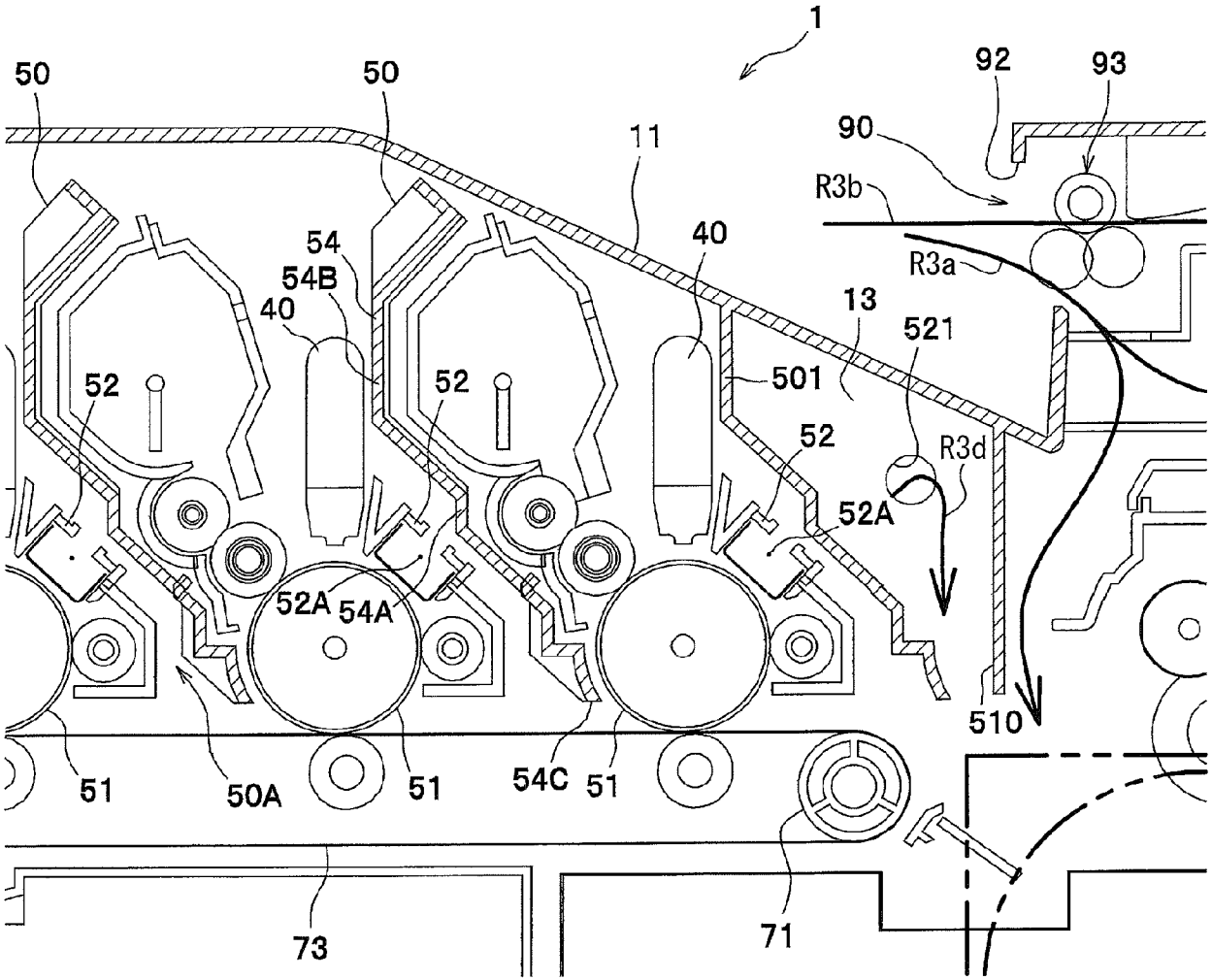
FIG. 6 is an enlarged cross-sectional view illustrating a modification of a partition wall and an intake port.

Although the partition wall 500 at the process cartridge 50 side, of the pair of partition walls 500 and 510, has a shape irrelevant to that of the process cartridges 50 in the above-described embodiment, the present invention is not limited to this configuration. For example, as shown in FIG. 6, a partition wall 501 may be formed to have the same shape as a front wall 54 of each process cartridge 50 (i.e. a wall facing the charger 52 of a forward-adjacent process cartridge 50). Specifically, the partition wall 501 may be formed so that the flow rate of air flowing between two adjacent process cartridges 50 (particularly, near the corresponding charger 52) is substantially equal to the flow rate of air flowing between the rearmost process cartridge 50 and the partition wall 501.

Specifically, the partition wall 501 may at least have the same shape as a segment 54A, of the front wall 54 of each process cartridge 50, that faces the corresponding charger 52 (in a direction connecting a charging wire 52A and a central axis of the corresponding photosensitive drum 51). The larger the partition wall 501 has an area with the same shape as the front wall 54, the better. In FIG. 6, the partition wall 501 and the front wall 54 have the same shape from a segment 54B facing the corresponding LED unit 40 in the front-rear direction to the lower end of the front wall 54.

By forming the partition wall 501 in this manner, the flow rate of air flowing near the chargers 52 can be made substantially the same so that the amount of waste adhering to the charging wires 52A can be made substantially uniform, whereby electric current to be applied to the charging wires 52A can be made substantially uniform.

Although the intake port 520 for taking in air into between the partition walls 500 and 510 from the outside is formed in the upper wall 15 of the apparatus body 10 in the above-described embodiment, the present invention is not limited to this configuration. For example, an intake port 521 may be formed in the side panel 13 of the apparatus body 10, as shown in FIG. 6, thereby air can be taken via a route R3*d*.

Figure 7:
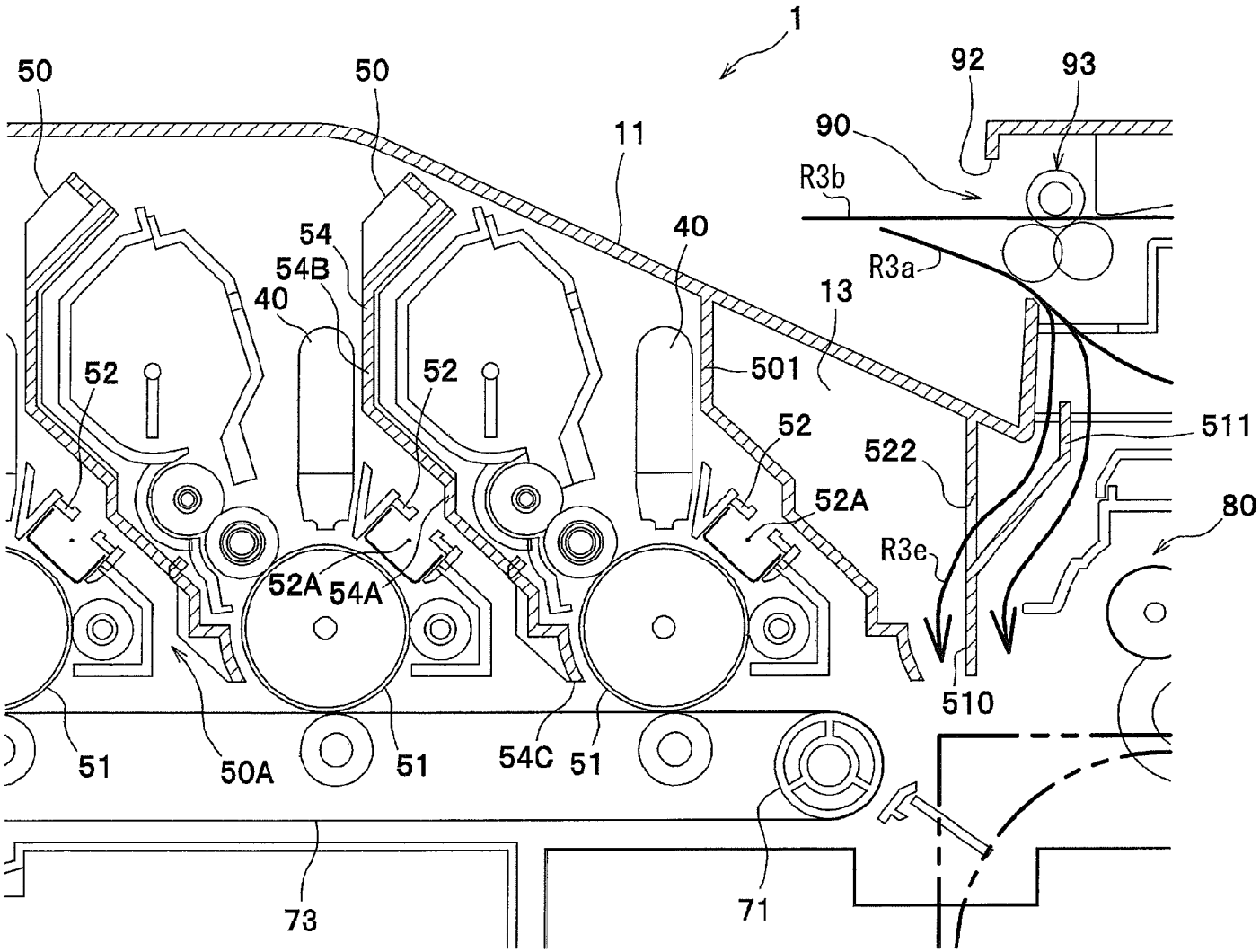
FIG. 7 is an enlarged cross-sectional view illustrating a modification of a partition wall.

Furthermore, as shown in FIG. 7, the partition wall 510 at the fixing unit 80 side may be provided with an opening 522 and an airflow controller 511 extending from the lower side of the opening 522 toward the ejection port 92. In detail, the airflow controller 511 is spaced apart from a wall that forms the ejection port 92 as well as from the partition wall 510 so as to form a flow channel together with these walls, and is formed so as to extend to a position higher than the halogen heater 81A. Consequently, even with this structure, air outside the apparatus can be taken into between the partition walls 500 and 510 via the ejection port 92 and the opening 522 via a route R3*e*.

Although the shield wall (i.e., the right wall 310 and the left wall 222) is provided for reducing the amount of air sucked into the exhaust fan 100 from the substrate container 300 in the above-described embodiment, the present invention is not limited to this configuration. Specifically, an alternative regulating unit that regulates the amount of air to be sucked into the exhaust fan 100 from the substrate container 300 may be provided so that the amount of air sucked into the exhaust fan 100 from the substrate container 300 is lower than or equal to the amount of air sucked into the exhaust fan 100 from the fixing unit 80 side. An example of such an alternative regulating unit may be a structure that reduces the size of the vent holes 13A formed in the side panel 13.

Although the present invention is applied to the color printer 1 in the above-described embodiment, the present invention may alternatively be applied to other image forming apparatuses, such as a monochrome printer, a copier, or a multi-function apparatus.

Although the photosensitive drum 51 is described as an example of a photosensitive member in the above-described embodiment, a belt-type photosensitive member, for example, may alternatively be used in the present invention.

Although the process unit is constituted of multiple process cartridges 50 in the above-described embodiment, the process unit may alternatively be constituted of for example, a single process cartridge in the present invention.

Although the sheet P, such as a cardboard, a postcard, or thin paper, is used as an example of a recording sheet in the above-described embodiment, an OHP sheet, for example, may alternatively be used in the present invention.

Although the halogen heater 81A is used as an example of a heat source in the above-described embodiment, an IH (induction heating) type heater or an exothermic resistor, for example, may alternatively be used in the present invention. As a further alternative, thin film belt fusing may be employed.

Although the feed tray 21 attachable to and detachable from the apparatus body 10 is described as an example of a recording-sheet accommodating section in the above-described embodiment, the recording-sheet accommodating section may alternatively be defined by a space formed in the apparatus body 10 for accommodating recording sheets in the present invention.

What is claimed is:

1. An image forming apparatus comprising:

a process unit having a charger that charges a photosensitive member;

a fixing unit having a heat source for thermally fixing a developer image formed on a recording sheet by the process unit;

an apparatus body configured to accommodate the process unit and the fixing unit and having an ejection port above the fixing unit, the ejection port being used for ejecting the recording sheet ejected from the fixing unit to the outside of the image forming apparatus; and an exhaust fan configured to discharge air inside the apparatus body to the outside of the image forming apparatus, the exhaust fan being disposed at a fixing-unit side of the process unit and being disposed lower than both the charger and the heat source such that air entering through the ejection port from outside the image forming apparatus flows through the fixing unit and is discharged by the exhaust fan, wherein the process unit comprises a plurality of process units, wherein the plurality of process units are arranged such that the chargers are arranged horizontally, and wherein a gap between the process units is formed slantwise relative to a vertical direction to provide a communication path to the exhaust fan such that ozone descending gravitationally from the plurality of process units is discharged by the exhaust fan.

2. The image forming apparatus according to claim 1, wherein the exhaust fan is disposed to overlap a section lower than the heat source of the fixing unit, as viewed in a width direction of the recording sheet.

3. An image forming apparatus comprising:

a process unit having a charger that charges a photosensitive member;

a fixing unit having a heat source for thermally fixing a developer image formed on a recording sheet by the process unit;

an apparatus body configured to accommodate the process unit and the fixing unit and having an ejection port above the fixing unit, the ejection port being used for ejecting the recording sheet ejected from the fixing unit to the outside of the image forming apparatus;

an exhaust fan configured to discharge air inside the apparatus body to the outside of the image forming apparatus, the exhaust fan being disposed at a fixing-unit side of the process unit and being disposed lower than both the charger and the heat source such that air entering through the ejection port from outside the image forming apparatus flows through the fixing unit and is discharged by the exhaust fan; a re-conveying path configured to switch back the recording sheet ejected outward from the image processing apparatus through the ejection port so as to re-convey the recording sheet to the process unit, and a duct connected to the exhaust fan, the duct extending in a width direction of the recording sheet and constituting a part of the re-conveying path, the duct having an intake port facing the re-conveying path to direct air from the path to the exhaust fan.

4. The image forming apparatus of claim 3, wherein the duct is configured to direct air from the fixing unit to the exhaust fan.

5. The image forming apparatus of claim 3, wherein the duct is configured to direct air from a substrate container to the exhaust fan.

6. The image forming apparatus of claim 3, wherein the duct comprises a merging portion, the merging portion being configured such that air from the process unit and a substrate container is directed through the duct to the exhaust fan and discharged by the exhaust fan.

7. An image forming apparatus comprising:

a process unit having a charger that charges a photosensitive member;

a fixing unit having a heat source for thermally fixing a developer image formed on a recording sheet by the process unit;

an apparatus body configured to accommodate the process unit and the fixing unit and having an ejection port above the fixing unit, the ejection port being used for ejecting the recording sheet ejected from the fixing unit to the outside of the image forming apparatus;

an exhaust fan configured to discharge air inside the apparatus body to the outside of the image forming apparatus, the exhaust fan being disposed at a fixing-unit side of the process unit and being disposed lower than both the charger and the heat source such that air entering through the ejection port from outside the image forming apparatus flows through the fixing unit and is discharged by the exhaust fan; and a first and a second partition wall configured to separate the process unit and the fixing unit from each other, the first and the second partition walls being spaced apart to form a communication channel for a flow of air from the ejection port to the exhaust fan and disposed between the process unit and the fixing unit.

8. The image forming apparatus according to claim 7, further comprising an intake port for taking in air from outside the image forming apparatus is formed between the first and the second partition walls in the apparatus body.

9. The image forming apparatus according to claim 8, wherein the first partition wall extends lower than the charger and the second partition wall extends lower than the heat source.

10. The image forming apparatus of claim 8 further comprising a duct connected to the exhaust fan, the duct being located below the first and second partition walls to discharge the air taken in through the intake port.

11. The image forming apparatus according to claim 1, wherein the exhaust fan is the only exhaust fan disposed within the apparatus body.

12. An image forming apparatus comprising:

a process unit having a charger that charges a photosensitive member;

a fixing unit having a heat source for thermally fixing a developer image formed on a recording sheet by the process unit;

an apparatus body configured to accommodate the process unit and the fixing unit and having an ejection port above the fixing unit, the ejection port being used for ejecting the recording sheet ejected from the fixing unit to the outside of the image forming apparatus;

an exhaust fan configured to discharge air inside the apparatus body to the outside of the image forming apparatus, the exhaust fan being disposed at a fixing-unit side of the process unit and being disposed lower than both the charger and the heat source, an air duct having at least a connecting portion having a connection port with an opening that is connected to the exhaust fan, and a second connection port with at least one communication opening that is configured as an air communication path; and a filter container having a first filter configured to filter waste as air flows therethrough and a second filter configured to filter ozone, the first and second filters being disposed on an upper end of the filter container, the filter container being substantially opened at the upper end, the filter container having at least one corresponding communication opening with the at least one communication opening in the connection portion, wherein air flowing through the filter container flows into the connecting portion via the air communication path, wherein an additional exhaust fan is not disposed at the fixing-unit side of the process unit and between the exhaust fan and the ejection port, and wherein a power-supply substrate configured to receive electricity from an external power source is disposed so as to overlap the exhaust fan in a rotation-axis direction of the exhaust fan.

13. The image forming apparatus according to claim 12, further comprising a substrate container having a segmented wall on at least three sides.

14. The image forming apparatus of claim 13, wherein at least a portion of the segmented wall forms a shield wall configured to restrict air inside the substrate container from being discharged by the exhaust fan.

* * * * *